United States Patent [19]

Wenger et al.

[11] 4,408,725

[45] Oct. 11, 1983

[54] SCREW AND HEAD ASSEMBLY FOR PROCESSING WHOLE GRAINS AND CELLULOSIC MATERIALS

[75] Inventors: Lavon G. Wenger; Bobbie W. Hauck, both of Sabetha, Kans.

[73] Assignee: Wenger Manufacturing, Sabetha, Kans.

[21] Appl. No.: 378,994

[22] Filed: May 17, 1982

Related U.S. Application Data

[63] Continuation of Ser. No. 210,683, Nov. 26, 1980, abandoned.

[51] Int. Cl.[3] ..... B02C 7/04

[52] U.S. Cl. ..... 241/260.1; 366/79; 366/90; 425/202

[58] Field of Search ..... 366/90, 88, 81, 79, 366/322, 324; 425/207, 208, 202; 99/277.2, 278, 276, 277; 241/260.1, 82.6

[56] References Cited

U.S. PATENT DOCUMENTS

| | | | |
|---|---|---|---|
| 2,765,491 | 10/1956 | Magerkurth | 366/90 |
| 3,788,612 | 1/1974 | Dray | 366/81 |
| 4,052,038 | 10/1977 | Brand | 366/90 |
| 4,107,788 | 8/1978 | Anders | 366/90 |
| 4,218,146 | 8/1980 | Housz | 366/90 |

*Primary Examiner*—Robert W. Jenkins

*Attorney, Agent, or Firm*—Schmidt, Johnson, Hovey & Williams

[57] ABSTRACT

An improved extruder screw section and barrel assembly is provided which is especially designed for effective extrusion processing of whole or cracked grains or cellulosic materials which can subsequently be converted to alcohol. The overall assembly includes an elongated, tubular head section presenting on the interior thereof at least one relatively sharp cutting edge (preferably in the form of a spiral rib), along with an elongated, axially rotatable screw section disposed within the head section. The screw section is characterized by a series of separate, elongated, circumferentially spaced grooves generally along the length of the section which progressively decrease in depth from one side margin of the grooves to the other, in the direction of screw rotation; thus, the material being processed is, by virtue of screw rotation and the groove configuration, pushed radially outwardly against the cutting edge presented by the surrounding barrel section. In this manner, the material is effectively subdivided or sliced to enhance the cooking thereof and maximize downstream alcohol production. In preferred forms, the screw section grooves are of progressively decreasing width and depth from the input end thereof to the output end, in order to increase the compressive forces on the material along the length of the section.

11 Claims, 6 Drawing Figures

10
12
14
16
18
20
22
24
26
28
30
32
34
36
38
40
42
44
46
48
50
52
2.

SCREW AND HEAD ASSEMBLY FOR PROCESSING WHOLE GRAINS AND CELLULOSIC MATERIALS

This is a continuation, of application Ser. No. 06/210,683 filed on Nov. 26, 1980, now abandoned.

BACKGROUND OF THE INVENTION

1. Field of the Invention

The present invention is broadly concerned with an improved screw section-barrel assembly forming a part of an elongated extruder, and which is particularly designed for the processing of starch-bearing or cellulosic materials in the production of alcohol therefrom. More particularly, it is concerned with such an assembly and screw section wherein the latter is provided with means on the periphery thereof for pushing the material outwardly against an adjacent cutting edge on the barrel during rotation of the screw section in order to effectively subdivide the material passing through the extruder so that maximum surface area is presented for cooking purposes.

2. Description of the Prior Art

The recent worldwide shortage of energy at a reasonable price has led to a plethora of proposals of alternate energy sources. For example, use of so called power alcohol derived from waste or agricultural products has been suggested, and in fact there is considerable activity in this area, particularly in the United States. Generally speaking, production of power alcohol from other grain or starch-bearing materials involves cooking the material followed by enzyme treatment thereof o convert the starch to sugars, and finally fermentation of the sugars to alcohol. While this process as broadly stated is extremely old, a number of investigators have proposed new methods and apparatus for maximizing alcohol production at minimum costs. For example, U.S. patent application Ser. No. 06/091,798 filed Nov. 6, 1979, now Patent No. 4,286,058, discloses a significant breakthrough in the area of alcohol production, inasmuch as a batch-continuous alcohol production process is disclosed which makes use of a modified extrusion cooker designed to effectively handle highly moisturized grain or other starch-bearing materials.

In order to maximize the production of alcohol from starch-bearing or cellulosic materials, it is desirable that these materials be subdivided to achieve the maximum possible surface area. This enhances both cooking and enzyme treatment. This need is particularly important in connection with extrusion processing of such materials during alcohol production, because of the relatively short residence time thereof in the extruder barrel, as compared with vat-type processes for example.

While more or less conventional extrusion apparatus can be used for alcohol production, there exists a real and heretofore unsatisfied need in the art for improved extrusion devices particularly designed for maximum subdivision of starting materials employed.

SUMMARY OF THE INVENTION

The present invention is especially designed for use in elongated extruders adapted for cooking of starch-bearing or cellulosic materials during the production of alcohol therefrom. To this end, the invention, when used in an extruder, serves to effectively subdivide a material being processed for maximizing cooking and ultimate alcohol production.

Broadly speaking, the invention includes an elongated, axially rotatably screw section disposed within a surrounding tubular barrel section. The screw section includes means on the periphery thereof for pushing material outwardly against the surrounding barrel, and the latter is equipped with structure which presents at least one relatively sharp cutting edge thereon. In this manner, the material being processed is subdivided and effectively "sliced" during rotation of the screw section.

In more detail, the preferred screw section of the invention includes an elongated, axially rotatable body having structure on the periphery thereof which defines a series of separate, circumferentially spaced, elongated grooves extending generally along the length of the body. The grooves progressively decrease in depth from one side margin thereof to the other side margin, preferably in the direction of rotation of the screw section, in order to achieve the effects outlined above. In further preferred forms, the grooves progressively decrease in both width and depth from the input end of the screw section to the output end thereof. Moreover, the groove-defining structure includes a series of circumferentially spaced, generally radially oriented, elongated grooved side wall surfaces, and corresponding grooved bottom wall surfaces joined thereto. The bottom wall surface extend from the joinder with the corresponding side wall surfaces to the outer periphery of the screw body, in a direction counter to the direction of rotation of the screw section.

The tubular barrel section is preferably provided with one or more continuous, spiral ribs on the interior thereof which present spaced apart, relatively sharp cutting edges which coact with the adjacent rotatable screw section.

DESCRIPTION OF THE PREFERRED EMBODIMENT

Figures 1, 2, 3, 4, 5, 6:
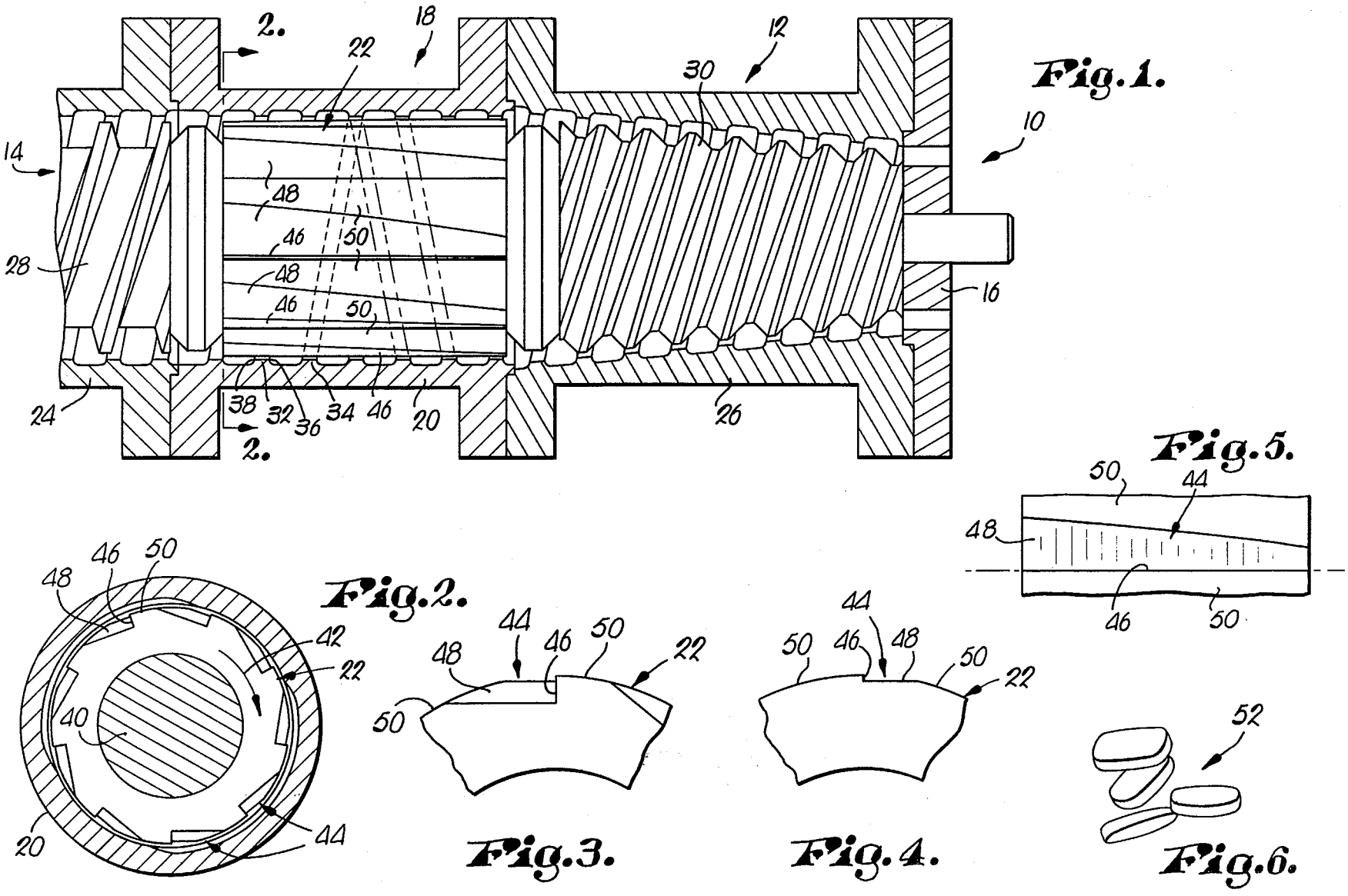
FIG. 1 is a fragmentary view in partial vertical section illustrating the outward end of an extruder having the screw and barrel section assembly of the invention thereon.
FIG. 2 is a vertical section of view taken along line 2—2 of FIG. 1, and which illustrates the input end of the screw section.
FIG. 3 is an enlarged, fragmentary view illustrating the groove configuration at the input end of the screw section.
FIG. 4 is an enlarged, fragmentary view similar to that of FIG. 3 but illustrating the groove configuration at the output end of the screw section.
FIG. 5 is an enlarged, fragmentary elevational view illustrating one of the screw section grooves.
FIG. 6 is a view depicting sliced or slivered corn after passage thereof through the extruder depicted in FIG. 1.

Turning now to the drawing, an extruder 10 in accordance with the invention is illustrated. For the most part, extruder 10 is of conventional construction and includes an elongated, multiple section barrel 12 along with an elongated, multiple-section, axially rotatable screw 14 therein. An aperatured extrusion die 16 is located at the output end of extruder 10 for extrusion of products therethrough.

An assembly 18 forms a part of overall extruder 10 and includes an elongated, tubular barrel section 20 along with a specialized screw section 22 therewithin. As can be seen, the barrel section 20 is operatively coupled and in communication with adjacent barrel sections 24 and 26, whereas screw section 22 is operatively coupled to fore and aft screw sections 28, 30.

Barrel section 22 includes structure defining on the interior surface thereof a pair of adjacent, spaced apart spiral ribs 32, 34. Each spiral rib presents a pair of spaced apart, relatively sharp outermost edges 36, 38 which extend the full length of each rib 32, 34.

Screw section 22 is in the form of an elongated, axially rotatable body in tubular form and mounted on a central spline 40. The section 22 is mounted for rotation in a clockwise direction as viewed in FIG. 2, and as illustrated by directional arrow 42.

The screw section includes structure on the periphery thereof defining a series of separate, circumferentially spaced, elongated grooves 44. Each groove 44 extends generally along the length of the screw section and is furthermore progressively decreasing in depth from one side margin of the groove to the other side margin thereof.

Referring specifically to FIG. 2, it will be seen that each groove is defined by an elongated, generally outwardly and radially extending sidewall surface 46, and a corresponding groove bottom wall surface 48 joined to a corresponding sidewall surface 46. Each bottom wall surface 48 extends from its joinder with the associated side wall surface 46 to the outer periphery of screw section 22, in a direction counter to the normal direction of rotation of the screw section. Hence, in the direction of the rotation of the screw section, the respective grooves 44 decrease in depth. Further, as best seen in FIGS. 2 and 3, respective land-defining elongated surfaces 50 are presented between the outermost margin of each bottom wall surface 48 and the adjacent sidewall surface 46. In this manner, the periphery of screw section 22 is defined by a series of alternating lands and grooves.

In the most preferred form of the screw section 22, the separate grooves 44 progressively decrease in width from the input end thereof to the output end thereof, and moreover progressively decrease in depth in this same manner. This construction will readily be observed from a comparison of FIGS. 3 and 4, wherein FIG. 3 illustrates the input end of a groove 44, whereas FIG. 4 depicts the output end thereof. As will be seen, the height of the sidewall surface 46 decreases, whereas the width of the section 48 likewise decreases.

In the operation of extruder 10 having assembly 18 as a part thereof, material to be processed is fed through the input end (not shown) of the extruder, whereupon it travels through barrel 12 and ultimately through the aperatures in die 16. During passage of the material through assembly 18 however, it is subjected to a slicing or slivering action serving to effectively subdivide the material for maximizing the surface area thereof. For example, if whole corn is fed through extruder 10, it emerges in the form of thin slices or slivers as illustrated in FIG. 6. These slices 52 present a significantly increased surface area rendering the corn especially susceptible to cooking and enzymatic attack during downstream processing.

The slicing or slivering action obtained is believed to occur in the following manner. As the material passes into the region of assembly 18, it fills the grooves 44. The decreasing side-to-side depth of the grooves, along with their decreasing width and depth from the input end to the output end thereof serves to push the material radially outwardly against the barrel section 20 and particularly against the relatively sharp cutting edges 36 and 38 presented by the ribs 32, 34. This serves to shear cut or slice the material into the thin slivers described. In addition, the significant pressure buildup which occurs by virtue of the progressively constricted nature of the grooves 48 assures that, by the time the material reaches the output end of the section 22, it is virtually completely subdivided as desired. Thus, the present invention permits use of an extruder in the production of power alcohol with maximum effective cooking and enzymatic conversion.

Having thus described the invention, what is claimed as new and desired to be secured by Letters Patent is:

1. An extruder screw section, comprising:

an elongated, axially rotatable body having structure on the periphery thereof defining a series of separate, circumferentially spaced, elongated grooves extending generally along the length of the body, each of said grooves being defined by spaced, opposed, elongated side margins extending generally lengthwise of said body, and an elongated, generally planar bottom wall joined to and extending between said side margins, said grooves progressively decreasing in depth in a direction transverse to the longitudinal axis of said body and from one side thereof to the other of said side margins.

2. The screw section as set forth in claim 1, said grooves progressively decreasing in width from one end thereof to the other end.

3. The screw section as set forth in claim 1, said grooves progressively decreasing in depth from one end thereof to the other.

4. The screw section as set forth in claim 1, said groove-defining structure includes a series of generally radially oriented, elongated groove sidewall surfaces, and corresponding groove bottom wall surfaces joined thereto, said bottom wall surfaces extending from the joinder with the corresponding sidewall surfaces to the outer periphery of said body in a direction counter to the direction of rotation thereof.

5. The screw section as set forth in claim 1, including a series of outermost land-defining surfaces between adjacent grooves and extending generally along the length of said body.

6. In an extruder barrel assembly adapted to receive and convey a material:

a tubular barrel section presenting on the interior thereof at least one relatively sharp cutting edge;

a rotatable screw section disposed within said section and including an elongated body having means on the periphery thereof for pushing said material outwardly against said cutting edge during rotation of the screw section in order to subdivide said material, said means including structure defining a series of separate, circumferentially spaced, elongated grooves extending generally along the length of the body, said grooves progressively decreasing in depth from one side margin thereof to the other side margin.

7. The assembly as set forth in claim 6, said barrel section including a spiral rib on the interior thereof presenting said edge.

8. The assembly as set forth in claim 6, said grooves progressively decreasing in width from one end thereof to the other end.

9. The assembly as set forth in claim 6, said grooves progressively decreasing in depth from one end thereof to the other.

10. The assembly as set forth in claim 6, said groove-defining structure includes a series of generally radially oriented, elongated groove sidewall surfaces, and corresponding groove bottom wall surfaces joined thereto, said bottom wall surfaces extending from the joinder with the corresponding sidewall surfaces to the outer periphery of said body and in a direction counter to the direction of rotation thereof.

11. An extruder screw section, comprising:

an elongated, axially rotatable body having structure on the periphery thereof defining a series of separate, circumferentially spaced, elongated grooves extending generally along the length of the body, said grooves progressively decreasing in depth from one side margin thereof to the other side margin, said groove-defining structure including a series of generally radially oriented, elongated groove sidewall surfaces, and corresponding groove bottom wall surfaces joined thereto, said bottom wall surfaces extending from the joinder with the corresponding sidewall surfaces to the outer periphery of said body in a direction counter to the direction of rotation thereof.

* * * * *